US008061637B2

(12) United States Patent
Konetzka

(10) Patent No.: US 8,061,637 B2
(45) Date of Patent: Nov. 22, 2011

(54) GRINDING UNIT WITH MILL AS A COMPLETE AND INDEPENDENT MODULE

(75) Inventor: Georg Konetzka, Augsburg (DE)

(73) Assignee: Hosokawa Alpine Aktiengesellschaft, Augsburg (DE)

( * ) Notice: Subject to any disclaimer, the term of this patent is extended or adjusted under 35 U.S.C. 154(b) by 214 days.

(21) Appl. No.: 12/487,745

(22) Filed: Jun. 19, 2009

(65) Prior Publication Data

US 2009/0321547 A1 Dec. 31, 2009

(30) Foreign Application Priority Data

Jun. 27, 2008 (DE) ..... 10 2008 030 749

(51) Int. Cl.
*B02B 1/00* (2006.01)

(52) U.S. Cl. ..... 241/57

(58) Field of Classification Search ..... 241/57, 241/188.2, 285.3
See application file for complete search history.

(56) References Cited

U.S. PATENT DOCUMENTS

| | | | | |
|---|---|---|---|---|
| 2,324,018 | A * | 7/1943 | Petersen | 209/169 |
| 3,412,770 | A * | 11/1968 | Johnson | 241/243 |
| 4,143,823 | A * | 3/1979 | Judson, Jr. | 241/73 |
| 6,196,480 | B1 * | 3/2001 | Fukuda et al. | 241/18 |
| 6,543,710 | B2 * | 4/2003 | Konetzka et al. | 241/39 |
| 7,127,849 | B1 * | 10/2006 | Gayer | 49/386 |
| 7,156,331 | B2 * | 1/2007 | Takahashi et al. | 241/39 |
| 7,374,115 | B2 * | 5/2008 | Geiger et al. | 241/171 |
| 7,654,480 | B2 * | 2/2010 | Baer et al. | 241/36 |
| 2008/0008805 | A1 * | 1/2008 | Wang et al. | 426/518 |
| 2008/0072396 | A1 | 3/2008 | Baer et al. | 15/327.1 |

FOREIGN PATENT DOCUMENTS

| | | | |
|---|---|---|---|
| DE | 4124855 | A1 * | 3/1992 |
| DE | 9300910 | U1 | 4/1993 |
| DE | 201 12 211 | U1 | 1/2003 |

* cited by examiner

*Primary Examiner* — David J. Walczak
*Assistant Examiner* — Jennifer C Chiang
(74) *Attorney, Agent, or Firm* — Winston & Strawn LLP

(57) ABSTRACT

The invention concerns an impact mill suitable for installation in a container. To this end, the container must have an opening, e.g. a manhole with flange. The mill is designed as a complete and independent module without a separate mill housing, all functional components are mounted on a plate which is flanged onto the manhole.

14 Claims, 4 Drawing Sheets

GRINDING UNIT WITH MILL AS A COMPLETE AND INDEPENDENT MODULE

TECHNICAL FIELD

The invention concerns a grinding unit that includes a mill and that is suitable for installation in a container, especially is a filter or silo. The mill includes functional grinding components that are mounted on a cover that can be flanged onto an opening in the container.

BACKGROUND ART

Grinding units with a variety of different mill types are already known. They consist of a product feed unit, mill, product collection unit and fan. Some products require a high air flow rate to cool the product during grinding, these types of systems are operated in through-air mode. Other products are less temperature-sensitive and can be processed without a separate flow of cooling air. To aid transport of these products, the air can be circulated. The advantage of this solution is that elaborate product collection units such as cyclones or filters are not necessary.

German Patent DE 9300910 U1 describes a system for grinding sugar. In this instance, a mill is top-mounted directly on a container. The ground product is routed via this collection hopper to the discharge. In this example, the air is circulated through the mill, whereby the air from the collection hopper is extracted and supplied to the product inlet upstream of the mill.

Despite this device, improvements are still desirable, and these are now provided by the present invention.

SUMMARY OF THE INVENTION

The present invention now creates a grinding unit of the type described herein which is compact and cost-saving in design, easy to handle and which can be easily adapted to suit the relevant explosion-protective regulations in the case of potentially explosive products.

The invention relates to a grinding unit comprising a mill which is designed such that it can be inserted into an opening of a container and can furthermore be operated in this position. The container thereby assumes the function of the mill housing, meaning that an independent mill housing is no longer necessary.

BRIEF DESCRIPTION OF THE DRAWINGS

Other features and merits of the invention are shown in the attached drawing figures which illustrate preferred embodiments and wherein.

DETAILED DESCRIPTION OF THE INVENTION

The grinding unit consists of a mill in modular design and a container belonging to a process-technological system. The container destined to accommodate the mill has an opening with flange and hinge bearing. This opening can, for example, be a manhole that is designed to permit maintenance procedures.

In the invention design, the cover for this opening is designed as a functional mill component. The cover with functional components is equipped with a hinged connection consisting of a cover hinge with bearing so that the mill can be hinged out of the container. The cover can be locked by means of connecting elements and holds the mill securely in a position that is safe to operate.

The mill is installed in the cover as follows: on one side of the cover plate is the drive for the mill rotor. The shaft is routed through the cover plate. On the other side, the grinding element is fitted to the rotor and the stator is fixed. The mill inlet, i.e. the feed material inlet, is located on the top part of the cover.

The mill can, for example, be an impact mill with pin disc grinding unit. The container into which the mill is installed can be a filter or a silo.

In this way, it is possible with the invention-design unit to save on the actual mill housing. The functional components of the mill, namely drive, shaft, rotor, stator and product inlet, are fitted to the cover and are inserted as a complete module into a container with an opening, e.g. a filter, and the cover is connected securely with the flange on the opening.

Invention-design grinding systems can be designed to be operated with no air flowing through the mill, or in closed-air circuit or through-air mode.

The advantages of the invention are that the mill housing and thus a cost-intensive component is omitted. Savings arise especially in the case of pressure-proof systems. Besides this, there are no connecting ductings between mill and downstream system components.

This type of grinding unit design is especially advantageous for grinding sugar. Finely ground sugar is a potentially explosive product, meaning that the grinding system must be protected against explosion. Because sugar is not temperature-sensitive, processing is possible without any flow of cooling air.

The invention constitutes an inexpensive possibility of upgrading systems with mills because existing system components can still be used and the actual mill housing can be done away with. Over and above this, the machine being upgraded can be simply fitted by flanging the mill onto the manhole.

Figure 1:
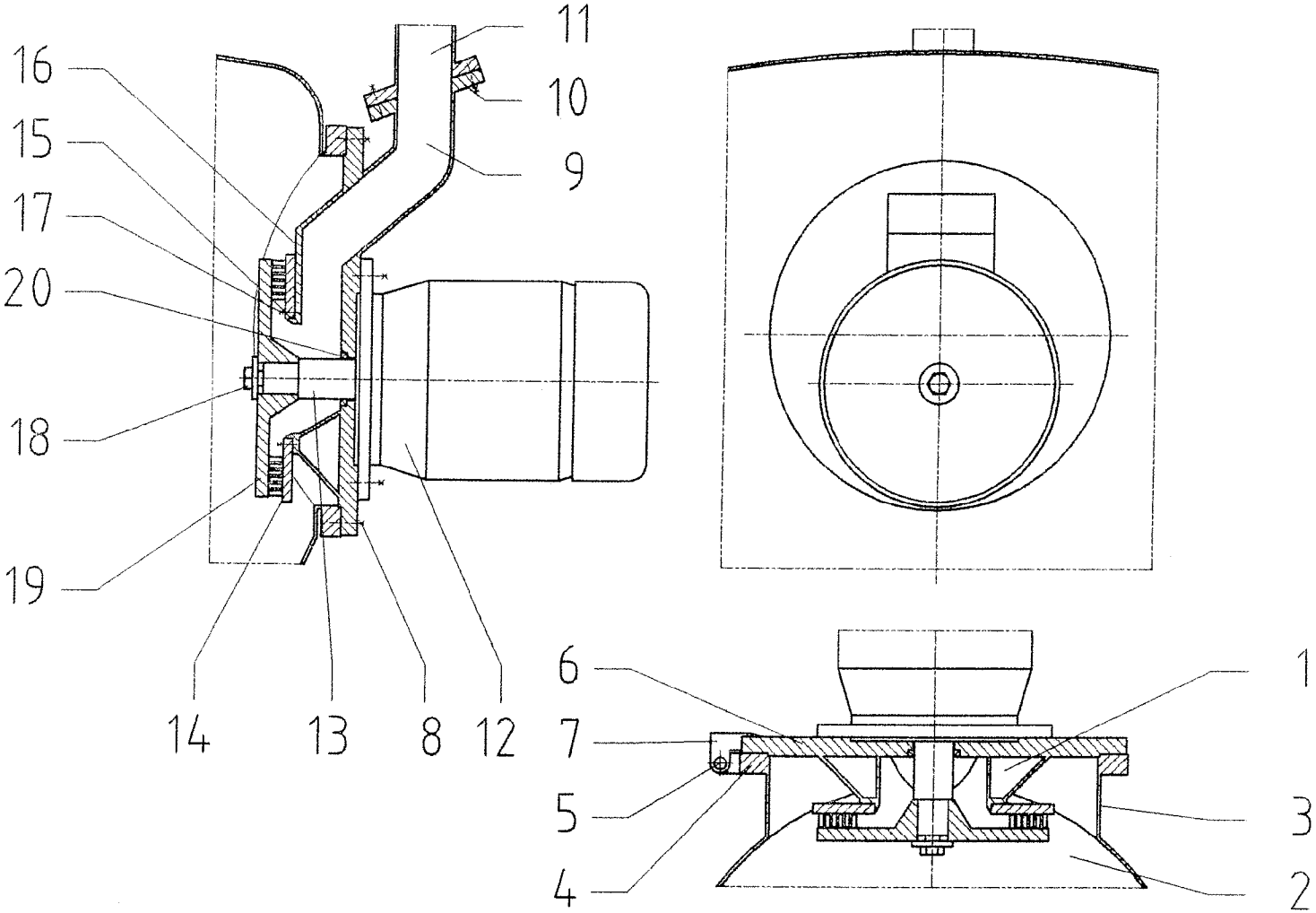
FIG. 1 includes three views of an impact mill with pin disc grinding unit as a complete module in a container, with a top view, a front cross-sectional view and a side cross-sectional view of the mill and container being provided.

FIG. 1 shows an impact mill (1) with pin disc grinding unit as an independent module in the container (2) of a process-technological system. The container (2) has an opening (3) with connection flange (4) and hinge bearing (5) to accommodate the impact mill (1). The cover (6) is designed as a functional mill component and is equipped with a hinged connection consisting of a cover hinge (7) with bearing (5) so that the mill can be hinged out of the container (2).

As shown in FIG. 1, the cover can be locked by means of connecting elements (8) which hold the mill securely in a position that is safe to operate. The mill inlet (9), which has an airtight connection to the fixed supply line (11) brought about by the inclined flange (10), is located in the top section of the cover (6). The mill drive (12) with mill shaft (13) is flanged to the bottom section of the cover (6). The stationary pin disc (14) is fixed by means of the close-tolerance borehole (15) in the inlet area so that it is concentric to the mill shaft and is fastened to the inside mill inlet channel (16) by means of the connecting elements (17). The rotating grinding disc (19) is fixed to the mill shaft (13) to be detachable by means of the connecting elements (18). The sealing system (20) seals the inlet in the area of the shaft bushing to the outside.

Figure 2:
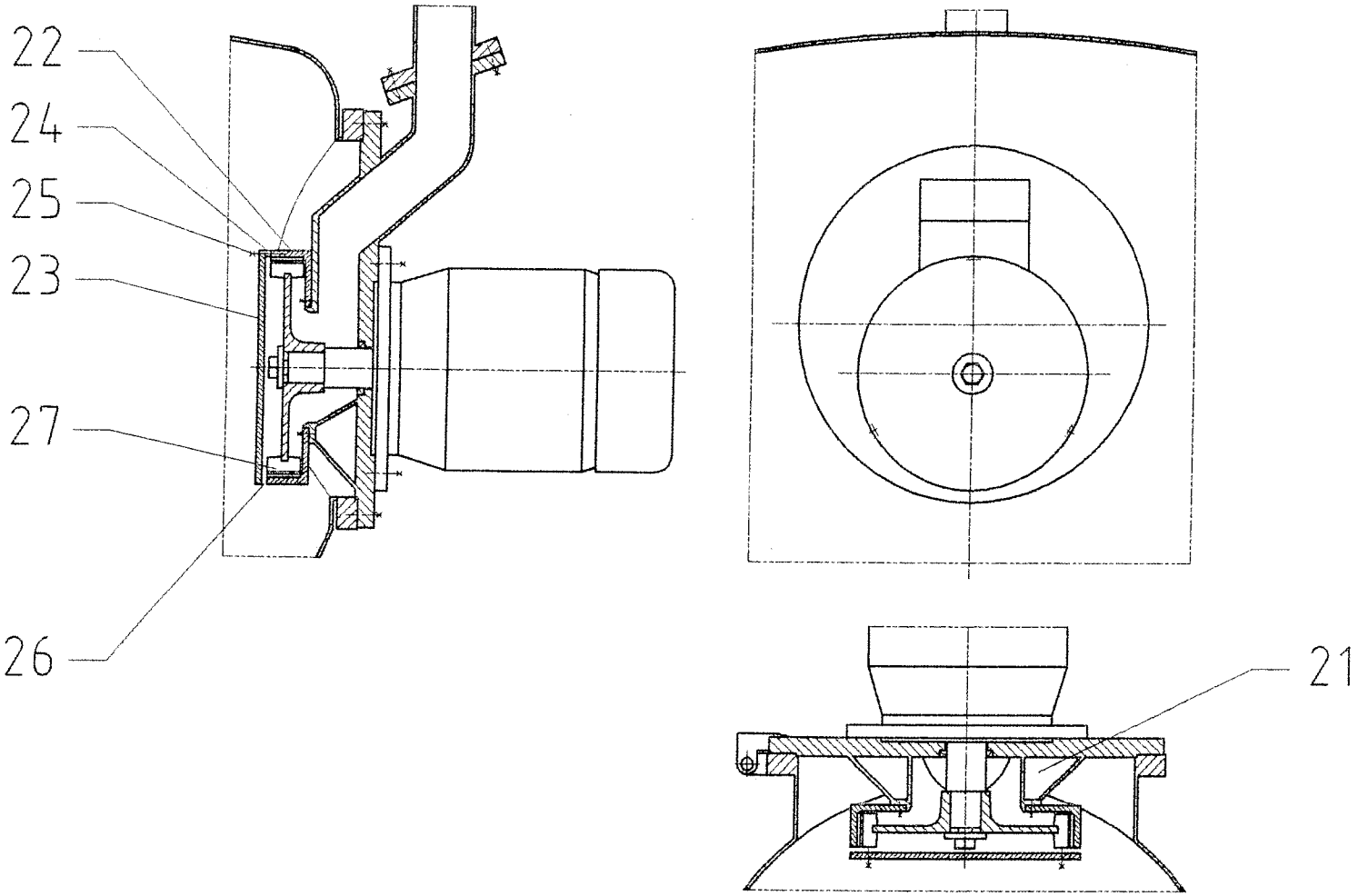
FIG. 2 includes three views of a plate beater grinding unit as a complete module in a container, with a top view, a front cross-sectional view and a side cross-sectional view of the mill and container being provided.

FIG. 2 shows an impact mill with plate beater grinding unit (21). Here, the triangular-ribbed grinding track (22) constitutes the stationary pin disc (14) known from FIG. 1 and is fitted to be detachable in the inlet area. Together with the spacers (24), the cover disc (23) forms the discharge gap (26) to the triangular-ribbed grinding track (22). To permit cleaning, the cover disc (23) is connected to be detachable by means of the connecting elements (25) to the triangular-ribbed grinding track (22).

Figure 3:
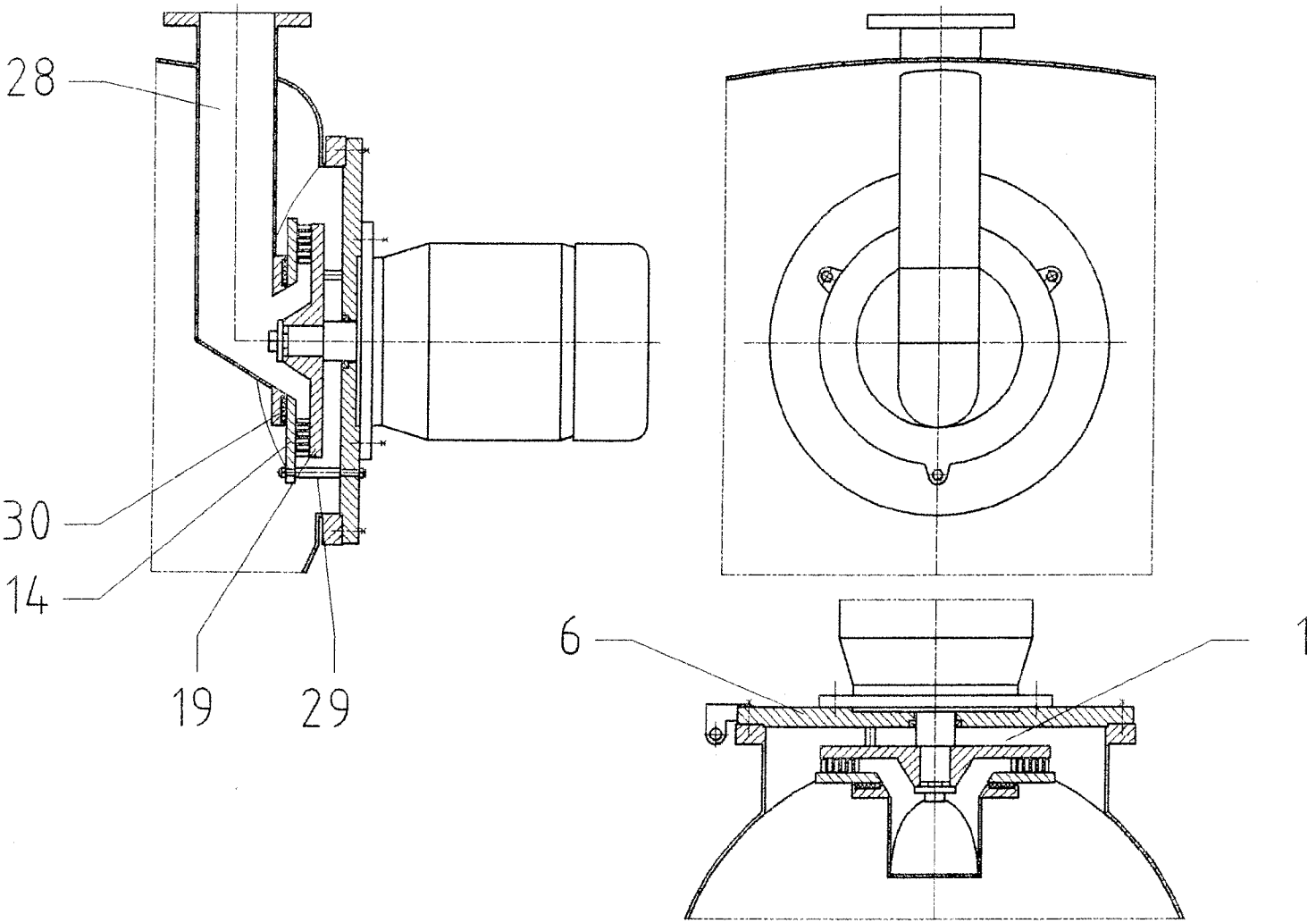
FIG. 3 includes three views of an impact mill as a complete module in a container, with a top view, a front cross-sectional view and a side cross-sectional view of the mill and container being provided.

FIG. 3 shows an impact mill with pin disc grinding unit (27) as a complete module in the container (2) of a process-technological system. In this design, the mill inlet (28) is an integral part of the container. The stationary pin disc (14) is connected to be detachable to the cover (6) by means of spacers (29) located at a defined clearance to the rotating pin disc (19). The space in between the flange of the product inlet and stationary pin disc (14) is preferably sealed with a soft seal (30). The mill inlet can also be connected to the container to be removable, so that with the mill hinged out of the container and the mill inlet removed, the opening in the container thus formed can be used as a manhole.

Figure 4:
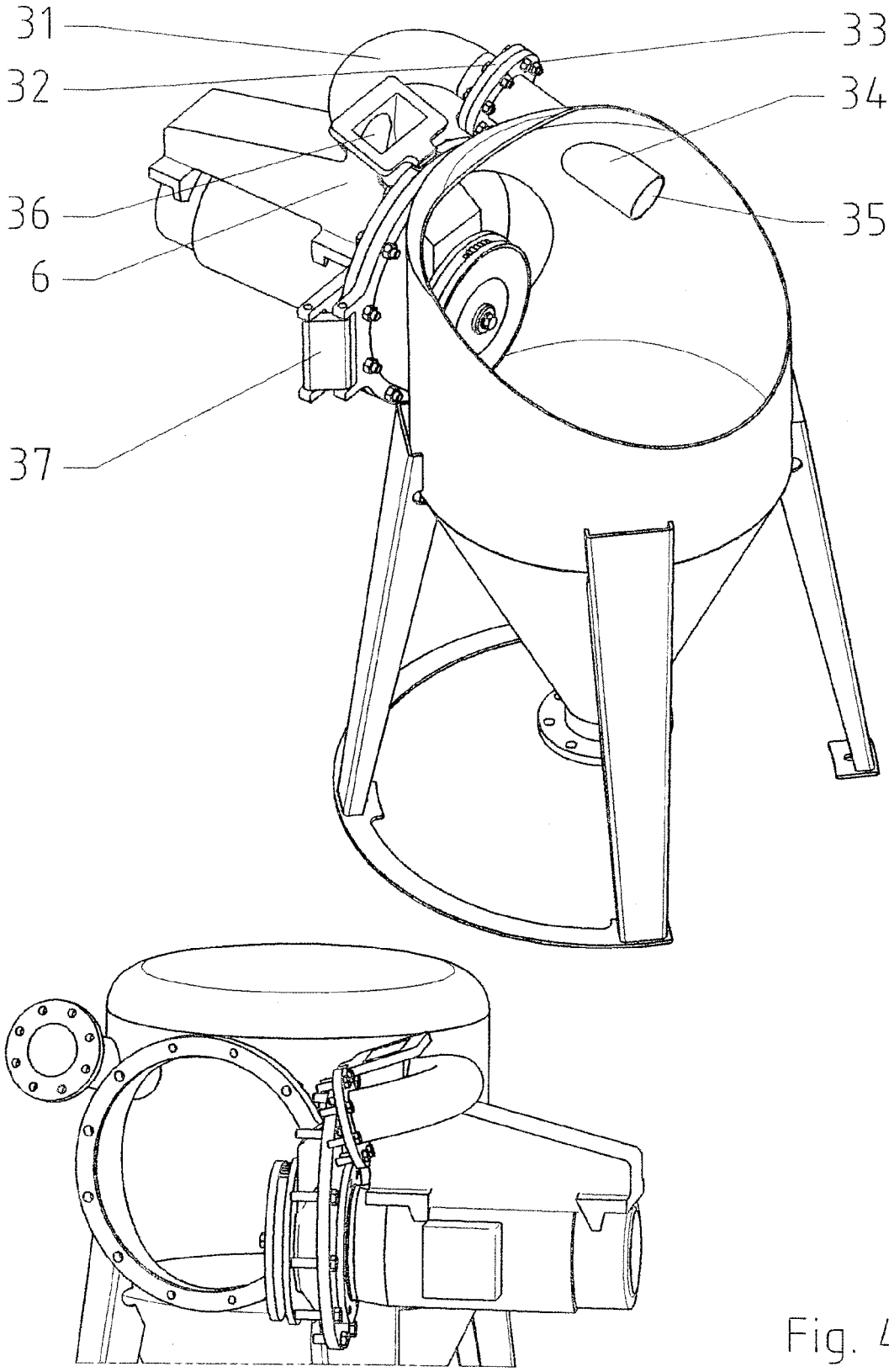
FIG. 4 is an illustration of an impact mill with the mill inlet as a component part of the container with a side view and a cut-away view being provided.

FIG. 4 shows the impact mill concept as described in FIG. 1 when closed (top view) and also with the mill module hinged out of the container (bottom view). As an extension of the concept, a system to permit circuit-air mode is integrated into the mill and container. To improve the ease of cleaning and to avoid unnecessary double grinding, the entire circuit-air system slopes down from the air inlet port (35) to the air outlet port (36); in addition, the installation of a filter at the air inlet port is also possible. To enable hinging of the impact mill through hinge 37, the air inlet ducting is split into two duct sections (31 and 34) with connection flanges (32 and 33) joined on respective ends of the ducts (31 and 34). Connection elements such as bolts then pass through the flanges (32 and 33) to secure the flanges (32 and 33) to another, and thus the ducts (31 and 34). To minimise the opening on the container as a function of how far the grinding elements are hinged out of the container, the door hinge (37) has two degrees of freedom which besides a circular swivelling movement, can also generate a straight trajectory.

The invention is not limited to the example described above and as shown in the figures.

What is claimed is:

1. A grinding unit comprising a container having an opening, a first connection flange, a cover, a mill inlet, and a grinding mill that includes functional mill components comprising a drive, a shaft, a rotor and a stator, wherein the functional mill components are located on the cover and the cover is equipped with a cover hinge and a second connection flange, wherein the cover hinge has hinge bearings that permit hinging movement of the cover away from the container to allow for inspecting and cleaning of the mill outside the container and wherein the cover can be locked by a plurality of connecting elements that pass through and connect the first and second connection flanges to one another.

2. The grinding unit of claim 1, wherein the mill is an impact mill with pin disc grinding unit or plate beater grinding unit.

3. The grinding unit of claim 1, wherein the container is a filter or silo.

4. The grinding unit of claim 1, wherein the mill inlet is located on the cover.

5. The grinding unit of claim 1, wherein the mill inlet is an integral part of the container.

6. The grinding unit of claim 1, wherein the container has an air inlet port which is connected to the mill inlet by ducting.

7. A process to comminute solids with a grinding unit, the grinding unit comprising:

a container having an opening, a first connection flange, a cover, a mill inlet, an air inlet port connected to the mill inlet, and a grinding mill that includes functional mill components comprising a drive, a shaft, a rotor and a stator, wherein the functional mill components are located on the cover and the cover is equipped with a cover hinge and a second connection flange, wherein the cover hinge has hinge bearings that permit hinging movement of the cover away from the container to allow for inspection or cleaning of the mill outside the container and wherein the cover can be locked by a plurality of connecting elements that pass through and connect the first and second connection flanges to one another, and the process comprises:

feeding solids to the grinding unit for comminution therein, wherein the grinding unit is operated either without air or in through-air or circuit-air mode, opening the cover to permit inspection or cleaning of the mill outside the container, and locking the cover to the grinding unit before comminuting the solids therein.

8. A combination comprising a grinding unit and a container, with the container having an opening, a first connection flange, and a cover, and the grinding mill including a mill inlet and functional mill components comprising a drive, a shaft, a rotor and a stator, wherein the functional mill components are located on the cover; the cover is equipped with a cover hinge and a second connection flange; the cover hinge has hinge bearings that permit hinging movement of the cover away from the container to allow for inspecting and cleaning of the mill outside the container; and the cover can be locked by a plurality of connecting elements that pass through and connect the first and second connection flanges to one another.

9. The combination of claim 8, wherein the mill is an impact mill with pin disc grinding unit or plate beater grinding unit.

10. The combination of claim 8, wherein the container is a filter or silo.

11. The combination of claim 8, wherein the mill inlet is located on the cover.

12. The combination of claim 8, wherein the mill inlet is an integral part of the container.

13. The combination of claim 8, wherein the container has an air inlet port which is connected to the mill inlet by ducting.

14. A process to comminute solids with a combination comprising:

a grinding unit and a container, with the container having an opening, a first connection flange, and a cover, and the grinding mill including a mill inlet and functional mill components comprising a drive, a shaft, a rotor and a stator, wherein the functional mill components are located on the cover; the cover is equipped with a cover hinge and a second connection flange; the cover hinge has hinge bearings that permit hinging movement of the cover away from the container to allow for inspecting and cleaning of the mill outside the container; and the cover can be locked by a plurality of connecting elements that pass through and connect the first and second connection flanges to one another, and the process comprises:

feeding solids to the grinding unit for comminution therein, wherein the grinding unit is operated either without air or in through-air or circuit-air mode, opening the cover to permit inspection or cleaning of the mill outside the container, and locking the cover to the grinding unit before comminuting the solids therein.

* * * * *